US007980850B2

(12) United States Patent
Abbasi et al.

(10) Patent No.: US 7,980,850 B2
(45) Date of Patent: Jul. 19, 2011

(54) SELF-RECUPERATED, LOW $NO_x$ FLAT RADIANT PANEL HEATER

(75) Inventors: Hamid A Abbasi, Naperville, IL (US); Harry S. Kurek, Dyer, IN (US); Mark J. Khinkis, Morton Grove, IL (US); Yaroslav Chudnovsky, Skokie, IL (US); Vladimir W. Kunc, Clarendon Hills, IL (US); Antoine de La Faire, Paris (FR); Antonin Touzet, Villeparisis (FR); Anatoly E. Yerinov, Kiev (UA); Lubov A. Yerinova, legal representative, Kiev (UA); Aleksey M. Semernin, Kiev (UA)

(73) Assignee: Gas Technology Institute, Des Plaines, IL (US)

( * ) Notice: Subject to any disclaimer, the term of this patent is extended or adjusted under 35 U.S.C. 154(b) by 1243 days.

(21) Appl. No.: 11/478,876

(22) Filed: Jun. 30, 2006

(65) Prior Publication Data

US 2008/0003531 A1 Jan. 3, 2008

(51) Int. Cl.
*F23D 11/44* (2006.01)

(52) U.S. Cl. ..... 431/215; 431/11; 431/207; 431/238; 431/326; 431/347; 126/91 R; 126/91 A; 126/92 AC; 126/85 B

(58) Field of Classification Search ..... 431/326, 431/215, 11, 347, 175, 177, 187, 284, 207, 431/238; 126/91 R, 91 A, 92 AC, 92 C, 101, 126/85 B, 85 R See application file for complete search history.

(56) References Cited

U.S. PATENT DOCUMENTS

| | | | | |
|---|---|---|---|---|
| 5,156,097 | A * | 10/1992 | Booth et al. | 110/214 |
| 5,431,147 | A * | 7/1995 | Tanaka et al. | 431/170 |
| 5,483,948 | A | 1/1996 | van der Veen | |
| 6,241,514 | B1 * | 6/2001 | Joshi et al. | 432/105 |
| 6,402,505 | B1 * | 6/2002 | Okada et al. | 431/18 |
| 6,431,857 | B1 * | 8/2002 | Charmes et al. | 431/328 |
| 6,932,079 | B2 * | 8/2005 | Johnson | 126/92 B |
| 2003/0111071 | A1 * | 6/2003 | Perrault | 126/77 |

FOREIGN PATENT DOCUMENTS

SU 1379465 2/1986

* cited by examiner

*Primary Examiner* — Steven B McAllister
*Assistant Examiner* — Avinash Savani
(74) *Attorney, Agent, or Firm* — Mark E. Fejer

(57) ABSTRACT

A method and apparatus for producing radiant heat in which a mixture of fuel and primary combustion oxidant is introduced into a combustion chamber having a heat radiating wall, which mixture has less than a stoichiometric requirement for complete combustion of the fuel, and igniting the mixture, forming heated partial combustion products. At least a portion of the heat in the heated partial combustion products is transferred to the heat radiating wall. The heated partial combustion products are passed from the combustion chamber into an exhaust gas plenum disposed adjacent to the combustion chamber. A secondary combustion oxidant is introduced into the exhaust gas plenum in an amount sufficient to complete combustion of the partial combustion products, forming exhaust gases. Heat in the exhaust gases is transferred to the primary combustion oxidant disposed in a combustion oxidant plenum disposed adjacent to said exhaust gas plenum.

32 Claims, 4 Drawing Sheets

SELF-RECUPERATED, LOW $NO_x$ FLAT RADIANT PANEL HEATER

BACKGROUND OF THE INVENTION

1. Field of the Invention

This invention relates to indirect radiant heaters, in particular, indirect flat radiant panel heaters. This invention relates to liquid and gaseous fuel flat radiant panel heaters which are self-recuperating and which produce low and ultra-low $NO_x$ emissions, typically less than about 100 vppm. This invention further relates to an indirect radiant heating apparatus employing flat radiant panel heaters.

2. Description of Related Art

Gas- and oil-fired, indirect radiant heaters are known to those skilled in the art. Typically, such radiant heaters take two forms—radiant tubes in which the heat radiating surface is a tubular structure constructed of suitable materials, and flat radiant panels. When employed in industrial heating applications, such as industrial furnaces and the like, the radiant tube heaters typically extend through the refractory roof, floor and/or sidewalls of the furnaces into the interior space. In contrast thereto, flat radiant panel heaters are a particularly attractive alternative because the compactness of such heaters allows easy installation in the refractory sidewalls, roof and, if necessary, in the furnace hearth. This allows displacement of the conventional refractory walls, refractory roofs and/or refractory hearths and provides a uniform heat flux to all sides of the load with low $NO_x$ levels in the combustion products and a high degree of temperature uniformity of the working surface, typically ±18° F. And, because they do not protrude into the interior space of the furnace, such space remains available for displacement by additional product material.

Radiant heaters may be of two designs, an open design in which the products of combustion can come into contact with the load, which, for example, in cases where the load is foodstuffs, may be undesirable, and a closed design in which the products of combustion are exhausted away from the load. It will be apparent to those skilled in the art that radiant heaters having a closed design are preferable to those having an open design. One such closed design radiant heater is taught by U.S. Pat. No. 5,483,948 to van der Veen.

The radiant heater of U.S. Pat. No. 5,483,948 comprises a closed housing which includes a combustion chamber, a flat radiant panel directed towards the article being heated, which panel forms a boundary of the combustion chamber, and at least one burner in which the combustion process is carried out in two stages, the first stage combustion being carried out external to and upstream of the combustion chamber and the second stage being carried out in the combustion chamber itself. The flame formed by the burner is directed at the radiant panel and gas guiding means are provided for recirculating the flue gases that have been passed along the radiant panel to the first or second combustion stage. It is stated that the contact of the radiant panel with the flue gases results in a cooling of the flue gases and that recirculating these cooled flue gases to the first or second combustion stage results in a cooling of the flame, which, in turn, results in a reduction in the $NO_x$ content of the flue gases. Recirculation of the cooled flue gases to the first combustion stage is effected through external recirculation means whereby the flue gases that have passed the radiant panel are mixed with the combustion air being fed to the first stage of the burner. Recirculation of the flue gases to the second stage is effected through internal recirculation in the combustion chamber with the walls of the combustion chamber serving as guiding means. It will be appreciated by those skilled in the art that the use of flue gas recirculation in the described manner adds a substantial degree of complexity to the burner design, particularly since means for recirculating the flue gases to both the first and second stages must be provided.

SUMMARY OF THE INVENTION

Accordingly, it is one object of this invention to provide a flat radiant panel heater in which the combustion is carried out in stages which avoids the complexities of the prior art designs.

It is another object of this invention to provide a flat radiant panel heater in which the combustion is carried out in stages using oxidant staging.

It is still a further object of this invention to provide a flat radiant panel heater utilizing oxidant staging in which both stages of oxidant are preheated.

It is a further object of this invention to provide a method for combustion of fuels in a flat radiant panel heater.

These and other objects of this invention are addressed by a flat radiant panel heater comprising a housing having a back wall, an opposed heat radiating front wall or panel and at least one side wall connecting the back wall with the heat radiating front wall. A combustion chamber wall is disposed within the housing at a distance from the heat radiating front wall, forming a combustion space or chamber between the combustion chamber wall and the heat radiating front wall. An exhaust gas plenum wall is disposed within the housing between the combustion chamber wall and the back wall, forming an exhaust gas plenum between the exhaust gas plenum wall and the combustion chamber wall and forming an oxidant plenum between the back wall and the exhaust gas plenum wall. An oxidant permeable distributor wall is disposed within the oxidant plenum at a distance from the exhaust gas plenum wall. Fuel and oxidant are provided to the combustion space by a nozzle mix burner nozzle extending through the back wall, through the oxidant permeable distributor wall and through the exhaust gas plenum wall and having a fuel inlet, an oxidant inlet and a fuel/oxidant mixture outlet, the latter of which is in fluid communication with the combustion space. A primary combustion oxidant conduit provides fluid communication between the oxidant plenum and the oxidant inlet of the nozzle mix burner nozzle and an exhaust gas conduit provides fluid communication between the exhaust gas plenum and the exterior of the housing. Oxidant is supplied to the flat radiant panel heater through an oxidant supply conduit having an oxidant supply inlet external to the housing and an oxidant supply outlet in fluid communication with the oxidant plenum. Exhaust gas fluid communication means provide fluid communication between the exhaust gas plenum and the combustion space and secondary oxidant fluid communication means provide secondary oxidant from the oxidant plenum to at least one of the combustion space and the exhaust gas plenum.

In accordance with one preferred embodiment of this invention, the combustion chamber wall and the exhaust gas plenum wall have a conical shape so as to form a conical-shaped combustion space.

Operation of the self-recuperating, low $NO_x$ flat radiant panel heater in accordance with one embodiment of this invention comprises introducing a mixture of fuel and oxidant into the combustion chamber, which mixture comprises less than a stoichiometric requirement of oxidant for complete combustion of the fuel, and igniting the mixture, forming heated partial combustion products. At least a portion of the heat in the heated partial combustion products is transferred to a substantially flat radiant panel disposed along one side of the combustion chamber and oriented so as to close off the one side of the combustion chamber. The heated partial combustion products are passed from the combustion chamber into an exhaust gas plenum disposed adjacent to the combustion chamber. A secondary combustion oxidant is introduced into the exhaust gas plenum in an amount sufficient to complete combustion of the partial combustion products, forming exhaust gases. Heat in the exhaust gases is transferred to oxidant contained in the oxidant plenum disposed adjacent to the exhaust gas plenum, after which the exhaust gases are exhausted from the exhaust gas plenum.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
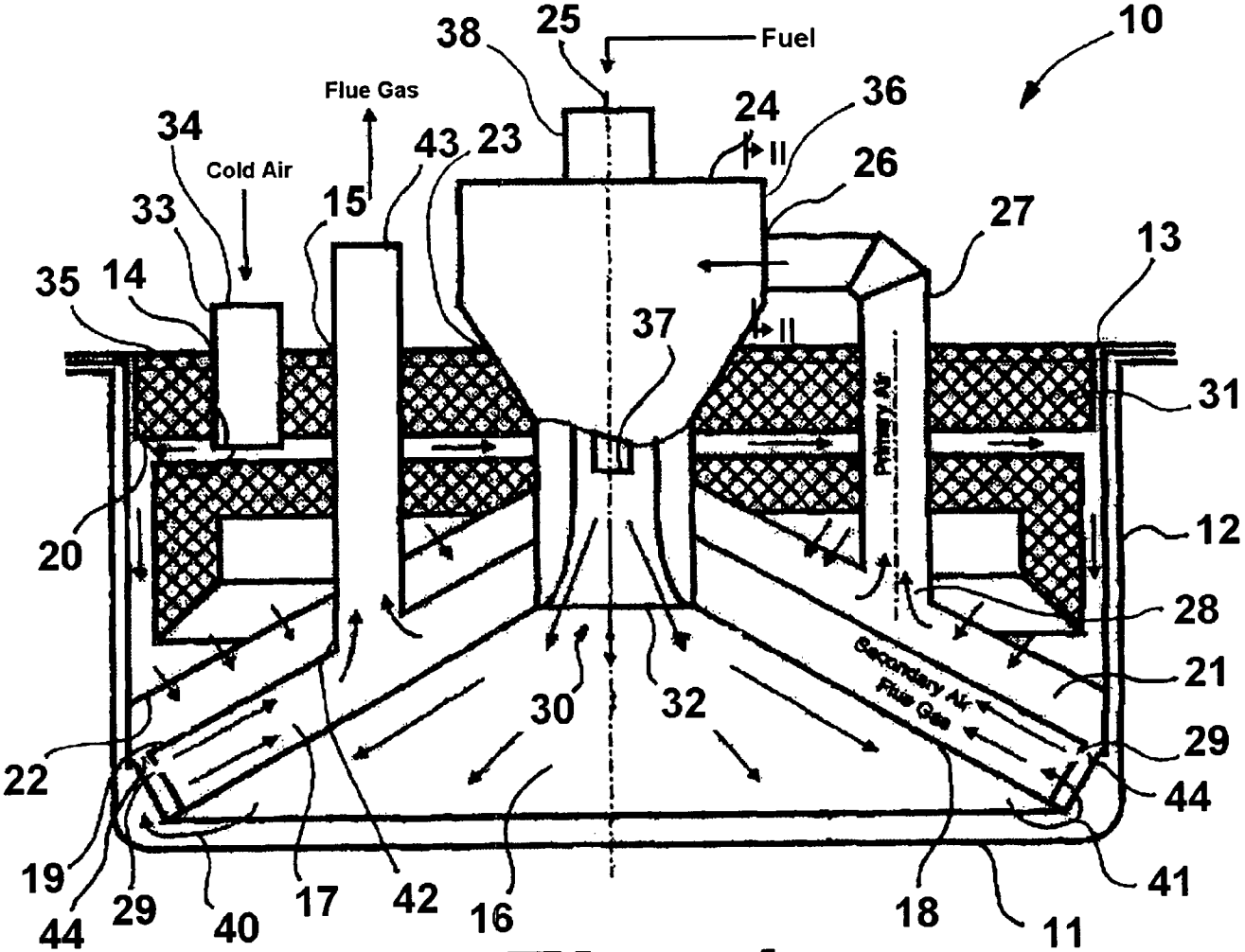
FIG. 1 is a cross-sectional lateral view of a self-recuperating, flat radiant panel heater in accordance with one embodiment of this invention.

The flat radiant panel heater 10, in accordance with one preferred embodiment of this invention as shown in FIG. 1, comprises a housing having a back wall 13, an opposed heat radiating wall or panel 11, and at least one side wall 12 connecting the back wall 13 with the heat radiating wall 11. Disposed within the housing is a cone-shaped combustion chamber wall 18, forming a cone-shaped combustion chamber 16. An exhaust gas plenum wall 19 is disposed between combustion chamber wall 18 and back wall 13, forming oxidant plenum 20 between exhaust gas plenum wall 19 and back wall 13 and forming exhaust gas plenum 17 between exhaust gas plenum wall 19 and combustion chamber wall 18. Nozzle mix burner nozzle 24 having a fuel inlet 25, an oxidant inlet 26 and a fuel/oxidant mixture outlet 32, in which fuel and primary oxidant are mixed prior to being introduced into combustion chamber 16, extends through nozzle opening 23 formed by back wall 13 into the housing and through exhaust gas plenum wall 19 and combustion chamber wall 18 terminating in the apex portion 30 of combustion chamber 16. Oxidant supply conduit 33 having oxidant supply inlet 34 and oxidant supply outlet 35 is shown extending through opening 14 of back wall 13, providing fluid communication between the exterior of the housing and oxidant plenum 20. By virtue of this arrangement, oxidant that is introduced through oxidant supply conduit 33 into oxidant plenum 20 is heated by transfer of heat from exhaust gases disposed within exhaust gas plenum 17 through exhaust gas plenum wall 19 prior to being introduced into nozzle mix burner nozzle 24.

In accordance with one preferred embodiment of this invention, radiant panel heater 10 further comprises oxidant permeable distributor wall 22 disposed within oxidant plenum 20 at a distance from exhaust gas plenum wall 19, forming primary oxidant plenum 21 there between. Oxidant permeable distributor wall 22 forms primary combustion oxidant outlet 28 in fluid communication with primary combustion oxidant conduit 27 through which primary combustion oxidant is provided to nozzle mix burner nozzle 24.

In accordance with one preferred embodiment of this invention, nozzle mix burner nozzle 24 comprises a reducing diameter pipe section 36 into which the first stage of oxidant, preferably in the range of about 50% to about 99% of the stoichiometric requirement for complete combustion of the fuel, is introduced. The reducing diameter pipe accelerates the oxidant flow and helps to establish the desired flame pattern. Located coaxially within the reducing diameter pipe section 36 is a fuel nozzle 38 through which a gaseous or liquid fuel is injected into the nozzle mix burner nozzle 24. As shown in FIG. 1, the fuel outlet end 37 of fuel nozzle 38 is disposed upstream of the fuel/oxidant mixture outlet 32 of nozzle mix burner nozzle 24. By virtue of this arrangement, the fuel is injected into the primary combustion oxidant stream flowing around fuel nozzle 38. When ignited, the fuel/oxidant mixture burns in a thin sheet of an oxygen-deficient flame, which is attached to the at least one combustion chamber wall 18. The oxygen-deficient conditions minimize $NO_x$ formation by reducing the availability of oxygen for $NO_x$ formation as well as the flame temperature. The reduced flame temperature, together with the longer flame resulting from the deficiency of oxygen, increase the temperature uniformity of flat radiant panel 11, which, in turn, increases its life as well as the quality of the material being heated.

As shown in FIG. 1, exhaust gas plenum 17 is disposed around the periphery of conical combustion chamber 16 adjacent to combustion chamber wall 18. Exhaust gas plenum 17 is provided with exhaust gas inlets 29 through which the partial combustion products formed by the oxidant-deficient combustion of the fuel/oxidant mixture in conical combustion chamber 16 are passed into exhaust gas plenum 17 as indicated by arrows 40, 41. Exhaust gas conduit 15, shown in FIG. 1 extending through an opening formed by back wall 13, comprises exhaust gas inlet end 42 which is in fluid communication with exhaust gas plenum 17 and exhaust gas outlet end 43, whereby exhaust gases generated by the combustion process are exhausted from the radiant panel heater 10. Exhaust gas plenum 17 further comprises at least one secondary combustion oxidant opening 44 through which secondary combustion oxidant is introduced into exhaust gas plenum 17. In exhaust gas plenum 17, the secondary combustion oxidant mixes with the partial combustion products exhausted from combustion chamber 16 to form a secondary combustion zone in exhaust gas plenum 17 in which combustion of the combustibles remaining in the partial combustion products is completed. Secondary combustion oxidant represents in the range of about 50% to about 1% of the stoichiometric requirement for complete combustion of the total amount of fuel introduced into conical combustion chamber 16. In accordance with one preferred embodiment of this invention, secondary combustion oxidant opening 44 is disposed proximate the base portion of the conical combustion chamber 16 formed by the at least one combustion chamber wall 18. Because a significant amount of heat from the primary combustion zone is removed through flat radiant panel 11, the secondary combustion oxidant temperature is lowered, as a result of which secondary $NO_x$ formation is also reduced. To reduce heat loss through back wall 13, insulating layer 31 is provided on the combustion chamber facing surface of back wall 13.

Figure 2:
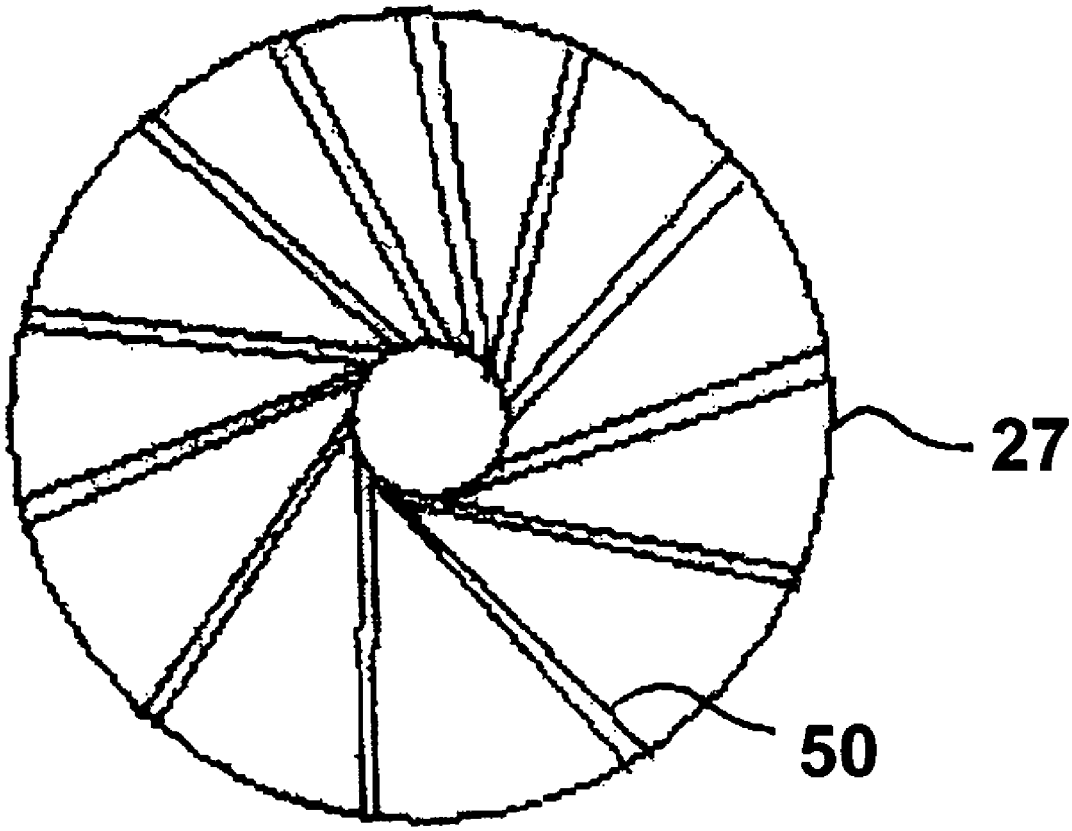
FIG. 2 is a view of a portion of the self-recuperating flat radiant panel heater shown in FIG. 1 along the line II-II.

In accordance with one embodiment of this invention, swirling means for imparting a swirl to the preheated primary combustion oxidant, such as swirler 50 shown in FIG. 2, are disposed within primary combustion oxidant conduit 27. Primary oxidant conduit 27 includes a primary oxidant inlet 28 in fluid communication with oxidant plenum 20 and primary oxidant outlet 26 in fluid communication with nozzle mix burner nozzle 24.

Figure 3:
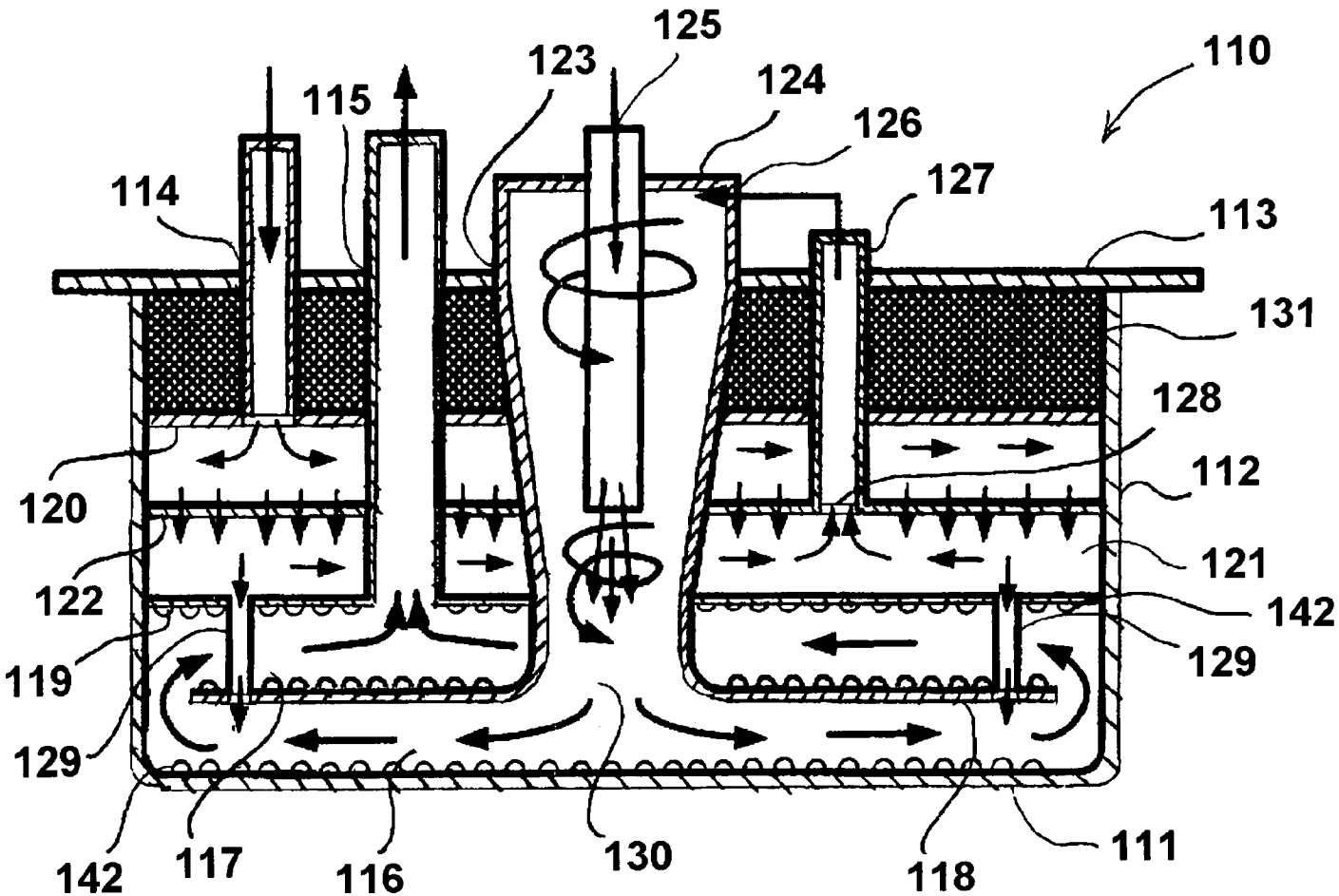
FIG. 3 is a cross-sectional lateral view of a self-recuperating, flat radiant panel heater in accordance with one embodiment of this invention.

A flat radiant panel heater 110 in accordance with another embodiment of this invention, as shown in FIG. 3, comprises a back wall 113, a heat radiating panel or wall 111 disposed substantially parallel to and spaced apart from the back wall 113, and at least one side wall 112 connected with the back wall 113 and extending to contact the heat radiating wall 111. Disposed between back wall 113 and heat radiating wall 111 is a combustion chamber wall 118, whereby combustion chamber 116 is formed between heat radiating wall 111 and combustion chamber wall 118. Exhaust gas plenum wall 119 is disposed between back wall 113 and combustion chamber wall 118, forming exhaust gas plenum 117 between exhaust gas plenum wall 119 and combustion chamber wall 118. Oxidant plenum wall 120 is disposed between back wall 113 and exhaust gas plenum wall 119, forming a primary oxidant plenum 121 there between. Back wall 113 forms a fuel inlet 123, an oxidant inlet 114 and an exhaust gas outlet 115 through which fuel is introduced into combustion chamber 116, oxidant is introduced into primary oxidant plenum 121, and exhaust gas disposed in exhaust gas plenum 117 is exhausted, respectively. To provide the functionality described in more detail herein below, the radiant panel heater in accordance with one embodiment of this invention further comprises fluid communication means for providing fluid communication between the combustion chamber 116 and the exhaust gas plenum 117, between the primary oxidant plenum 121 and the combustion chamber 116, between the fuel inlet 123 and the combustion chamber 116, between the exhaust gas plenum 117 and the exhaust gas outlet 115, and between the primary oxidant plenum 121 and the oxidant inlet 114. In accordance with one embodiment of this invention, fluid communication between primary oxidant plenum 121 and combustion chamber 116 comprises a plurality of oxidant conduits 129 extending between primary oxidant plenum 121 and combustion chamber 116.

In accordance with one embodiment of this invention, radiant panel heater 110 comprises premixing means for premixing a first portion of an oxidant (primary combustion oxidant) with a fuel for introduction into combustion chamber 116. In accordance with one preferred embodiment of this invention, radiant panel heater 110 further comprises a perforated plate 122 disposed within primary oxidant plenum 121 substantially parallel to and spaced apart from oxidant plenum wall 120 and exhaust gas plenum wall 119. In addition to perforations, perforated plate 122 forms a primary combustion oxidant outlet 128, which is in fluid communication with the premixing means, whereby the portion of oxidant to be premixed with the fuel is provided to the premixing means. Premixing means in accordance with one embodiment of this invention as shown in FIG. 3 comprises nozzle mix burner 124 having fuel inlet 125, oxidant inlet 126 and fuel/oxidant mixture outlet 130, the latter being in fluid communication with combustion chamber 116. Primary oxidant is provided to nozzle mix burner 124 through primary combustion oxidant conduit 127, which is in fluid communication with primary combustion oxidant outlet 128.

As previously indicated, one of the improved efficiencies of the radiant panel heater of this invention is provided by preheating of the primary combustion oxidant prior to premixing with the fuel. This preheating is accomplished by the transfer of heat in the hot exhaust gas disposed in exhaust gas plenum 117 through exhaust gas plenum wall 119 into primary oxidant plenum 121.

In accordance with one embodiment of this invention, to further promote the transfer of heat within the radiant panel heater, the radiant panel heater comprises at least one heat transfer enhancement. In accordance with one embodiment of this invention, the heat transfer enhancement comprises a plurality of dimples 142 disposed on at least one of the surfaces of exhaust gas plenum wall 119, the purpose of which is to promote turbulent flow of exhaust gases proximate exhaust gas plenum wall 119 and enhance the transfer of heat from the exhaust gases in exhaust gas plenum 117 to oxidant in primary oxidant plenum 121. Similarly, to promote the transfer of heat from the exhaust gases generated in combustion chamber 116 into the exhaust gases disposed within exhaust gas plenum 117, a plurality of dimples 142 are disposed on at least one surface of combustion chamber wall 118 in accordance with one embodiment of this invention. To promote heat transfer between heat radiating wall 111 and the environment proximate heat radiating wall 111 in accordance with one embodiment of this invention, a plurality of dimples 142 are disposed on at least one surface of heat radiating wall 111.

Profiling the heated (or cooled) wall surfaces of the radiant panel heater, in addition to providing enhancements to the heat transfer between fluids disposed on opposite sides of the wall(s), may be used to enhance wall surface corrosion/erosion resistance and/or provide improvements to hydrodynamic and/or combustion stability within the radiant panel heater.

In accordance with one embodiment of this invention, elements of surface roughness and turbulators, such as pimples, studs, cut fins, winglets, and the like, are disposed on at least one surface of exhaust gas plenum wall 119, combustion chamber wall 118 and/or heat radiating wall 111 for the purpose of heat transfer enhancement, corrosion/erosion resistance and/or hydrodynamic and/or combustion stability improvement. In accordance with yet another embodiment of this invention, one or more surfaces of one or more walls of the radiant panel heater are treated, such as by application of a nano coating, for the purpose of heat transfer enhancement, corrosion/erosion resistance and/or hydrodynamic and/or combustion stability improvement.

In accordance with one embodiment of this invention, radiant panel heater 110 further comprises an insulating layer 131 disposed on a combustion chamber facing surface of back wall 113.

Figure 4:
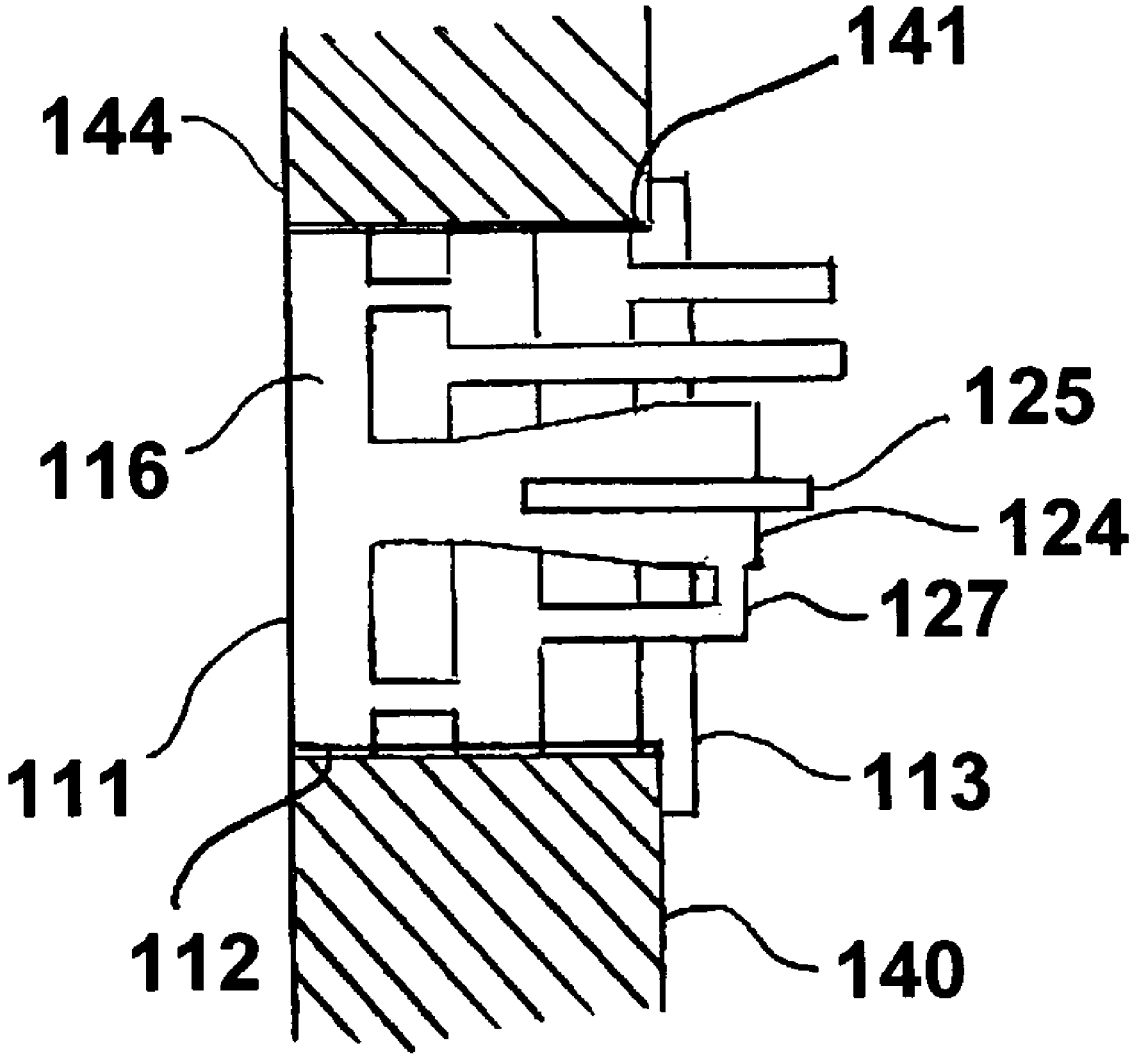
FIG. 4 is a lateral, partial cross-sectional view of a flat radiant panel heater in accordance with one embodiment of this invention disposed within a heating chamber wall opening.

FIG. 4 shows one embodiment of the radiant panel heater disposed within a radiant panel heater opening 141 formed by a heating chamber wall 140. As shown therein, in accordance with one preferred embodiment of this invention, radiating wall 111 is integral with the inside surface 144 of heating chamber wall 140.

The method for producing radiant heat in accordance with one embodiment of this invention comprises introducing a mixture of fuel and primary combustion oxidant into a combustion chamber, which mixture comprises less than a stoichiometric requirement for complete combustion of the fuel, and igniting the mixture, forming heated partial combustion products. Thereafter, at least a portion of heat in the heated partial combustion products is transferred to the heat radiating wall. The heated partial combustion products are passed from the combustion chamber into an exhaust gas plenum disposed adjacent to the combustion chamber. Secondary combustion oxidant is introduced into the exhaust gas plenum in an amount sufficient to complete combustion of the partial combustion products, forming exhaust gases. Heat in the exhaust gases is transferred to the primary combustion oxidant disposed in a combustion oxidant plenum disposed adjacent to the exhaust gas plenum. In accordance with one preferred embodiment of this invention, the secondary combustion oxidant, like the primary combustion oxidant, is preheated, preferably by heat from the hot exhaust gases.

In accordance with one embodiment of this invention, the mixture of fuel and primary combustion oxidant comprises in a range of about 50% to about 99% of the stoichiometric requirement for complete combustion of the fuel and the secondary combustion oxidant comprises in a range of about 50% to about 1% of the stoichiometric requirement for complete combustion of the fuel.

In accordance with one preferred embodiment of this invention, the fuel is a gaseous fuel selected from the group consisting of natural gas, coke oven gas, propane, recycled combustible effluent and mixtures thereof, and the oxidant is selected from the group consisting of oxygen, air and oxygen-enriched air.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. A radiant panel heater comprising:

a housing having a back wall, an opposed heat radiating front wall and at least one side wall connecting said back wall with said heat radiating front wall and having a combustion oxidant inlet and an exhaust gas outlet;

a combustion chamber wall disposed within said housing at a distance from said heat radiating front wall, forming a combustion space between said combustion chamber wall and said heat radiating front wall and forming an oxidant plenum between said combustion chamber wall and said back wall the oxidant plenum in fluid communication with said combustion oxidant inlet;

an exhaust gas plenum wall disposed entirely within said oxidant plenum, forming an exhaust gas plenum between said exhaust gas plenum wall and said combustion chamber wall and forming an exhaust gas plenum outlet, and an exhaust gas conduit providing fluid communication between said exhaust gas plenum outlet and said exhaust gas outlet;

an oxidant permeable distributor wall disposed within said oxidant plenum between said exhaust gas plenum wall and said back wall, forming an oxidant preheat plenum between said oxidant permeable distribution wall and said exhaust gas plenum wall;

a nozzle mix burner nozzle extending through a nozzle opening formed by each of said back wall, said oxidant permeable distributor wall and said exhaust gas plenum wall for receiving said burner nozzle and having a fuel inlet, a primary oxidant inlet, a swirler disposed in the primary oxidant inlet and a fuel/oxidant mixture outlet in fluid communication with said combustion space;

a primary combustion oxidant conduit providing fluid communication between said oxidant preheat plenum and said primary oxidant inlet;

exhaust gas fluid communication means for providing fluid communication between said exhaust gas plenum and said combustion space; and secondary oxidant fluid communication means for providing secondary oxidant from said oxidant preheat plenum to said exhaust gas plenum for mixing with exhaust gases in said exhaust gas plenum for completing combustion.

2. A radiant panel heater in accordance with claim 1, wherein said combustion space has a conical shape with an apex of said conical shape corresponding to said fuel/oxidant mixture outlet of said nozzle mix burner nozzle.

3. A radiant panel heater in accordance with claim 1, wherein said secondary oxidant fluid communication means comprises a plurality of secondary oxidant conduits extending from said oxidant preheat plenum to said combustion space.

4. A radiant panel heater in accordance with claim 1, wherein said oxidant permeable distribution wall is a perforated plate.

5. A radiant panel heater in accordance with claim 1, wherein said heat radiating front wall comprises an inside surface of a heating chamber wall.

6. A radiant panel heater in accordance with claim 1 further comprising at least one heat transfer enhancement means for enhancing heat transfer between fluids at least one of within and outside said housing.

7. A radiant panel heater in accordance with claim 6, wherein said at least one heat transfer enhancement comprises a plurality of dimples formed by at least one surface of at least one of said exhaust gas plenum wall, said combustion chamber wall and said heat radiating wall.

8. A radiant panel heater in accordance with claim 1, wherein an insulating layer is disposed on a combustion space facing surface of said back wall.

9. A method for producing radiant heat comprising the steps of:

providing a flat radiant panel heater comprising a housing having a back wall, an opposed flat heat radiating front wall and at least one side wall connecting said back wall with said flat heat radiating front wall;

introducing a mixture of a fuel and a primary combustion oxidant via a primary oxidant plenum into a combustion chamber, the mixture supplied through a nozzle extending through said back wall of the flat radiant panel heater, wherein the combustion chamber is disposed within said housing and comprising said flat heat radiating front wall, said mixture comprising less than a stoichiometric requirement for complete combustion of said fuel, and igniting said mixture, forming heated partial combustion products, the primary combustion oxidant is swirled via swirlers, the swirlers being located in an oxidant supply conduit;

transferring at least a portion of heat in said heated partial combustion products to said flat heat radiating front wall;

passing said heated partial combustion products from said combustion chamber into an exhaust gas plenum disposed adjacent to said combustion chamber wherein an entire wall comprising the exhaust gas plenum is disposed within the primary oxidant plenum;

introducing a secondary combustion oxidant into said exhaust gas plenum in an amount sufficient to complete combustion of said partial combustion products, forming exhaust gases; and transferring heat in said exhaust gases to said primary combustion oxidant disposed in a combustion oxidant plenum, the combustion oxidant plenum formed at least by one oxidant permeable wall, the combustion oxidant plenum disposed adjacent to and in heat exchange communication with said exhaust gas plenum.

10. A method in accordance with claim 9, wherein said mixture of fuel and said primary oxidant comprises in a range of about 50% to about 99% of said stoichiometric requirement for complete combustion of said fuel.

11. A method in accordance with claim 10, wherein said secondary combustion oxidant comprises in a range of about 50% to about 1% of said stoichiometric requirement for complete combustion of said fuel.

12. A method in accordance with claim 9, wherein said fuel is a gaseous fuel selected from the group consisting of natural gas, propane, coke oven gas, recycled combustible effluent and mixtures thereof.

13. A method in accordance with claim 9, wherein said oxidant is selected from the group consisting of oxygen, air, and oxygen-enriched air.

14. A method in accordance with claim 9, wherein said secondary combustion oxidant is preheated.

15. A method in accordance with claim 14, wherein said secondary combustion oxidant is preheated by heat from said exhaust gases.

16. A radiant heating apparatus comprising:

a heating chamber having at least one wall comprising at least one interior radiant heating section; and a combustion apparatus connected with said at least one wall, said combustion apparatus comprising a back wall substantially parallel to and spaced apart from said interior radiant heating section and having a fuel inlet, a primary oxidant inlet and an exhaust gas outlet, the primary oxidant inlet having a swirler for swirling primary oxidant, at least one side wall connected with said back wall and extending to contact said interior radiant heating section, a combustion chamber wall disposed between said back wall and said interior radiant heating section, forming a combustion chamber in fluid communication with said fuel inlet and said primary oxidant inlet between said combustion chamber wall and said interior radiant heating section and forming an oxidant plenum between said back wall and said combustion chamber wall, an exhaust gas plenum wall disposed entirely within said oxidant plenum, forming an exhaust gas plenum between said exhaust gas plenum wall and said combustion chamber wall, an oxidant permeable distributor wall disposed between said back wall and said exhaust gas plenum wall forming an oxidant preheat plenum between said oxidant permeable distributor wall and said exhaust gas plenum wall, a primary combustion oxidant conduit providing fluid communication between said oxidant plenum and said primary oxidant inlet, exhaust gas fluid communication means for providing fluid communication between said combustion chamber and said exhaust gas plenum, and secondary oxidant fluid communication means for providing secondary oxidant from said oxidant plenum to said exhaust gas plenum for mixing with exhaust gases in said exhaust gas plenum.

17. A radiant heating apparatus in accordance with claim 16, wherein said interior radiant heating section is integral with said at least one wall.

18. A radiant heating apparatus in accordance with claim 16, wherein said interior radiant heating section is disposed within an opening formed by said at least one wall.

19. A radiant heating apparatus in accordance with claim 16, wherein said combustion apparatus further comprises premixing means for mixing a first portion of an oxidant with a fuel, said premixing means having a premixed fuel/oxidant outlet in fluid communication with said combustion chamber.

20. A radiant heating apparatus in accordance with claim 19, wherein said oxidant permeable distributor wall forms a primary combustion oxidant outlet in fluid communication with said premixing means.

21. A radiant heating apparatus in accordance with claim 16, wherein said fluid communication between said primary oxidant plenum and said combustion chamber comprises a plurality of oxidant conduits extending between said primary oxidant plenum and said combustion chamber.

22. A radiant heating apparatus in accordance with claim 16, wherein at least one of said exhaust gas plenum wall, said combustion chamber wall and said interior heat radiating section comprises at least one heat transfer enhancement.

23. A radiant heating apparatus in accordance with claim 22, wherein said at least one heat transfer enhancement comprises a plurality of dimples formed by at least one surface of at least one of said exhaust gas plenum wall, said combustion chamber wall and said interior heat radiating section.

24. A radiant panel heater comprising:

a back wall, a heat radiating wall spaced apart from said back wall, and at least one side wall connected with said back wall and extending to contact said heat radiating wall, said back wall having a fuel inlet, an oxidant inlet and an exhaust gas outlet the oxidant inlet having swirling means wherein swirled oxidant mixes with fuel in a nozzle mix burner nozzle, the nozzle mix burner nozzle extending through the back wall of the radiant panel heater;

a combustion chamber wall disposed between said back wall and said heat radiating wall, forming a combustion chamber in fluid communication with said fuel inlet and said oxidant inlet between said combustion chamber wall and said heat radiating wall and forming a primary oxidant plenum between said combustion chamber wall and said back wall;

an exhaust gas plenum disposed entirely within said primary oxidant plenum having an exhaust gas inlet in fluid communication with said combustion chamber, a secondary oxidant inlet in fluid communication with said primary oxidant plenum, and an exhaust gas plenum outlet in fluid communication with said exhaust gas outlet; and an oxidant permeable wall disposed between said exhaust gas plenum and said back wall, forming an oxidant preheat plenum in heat exchange communication with said exhaust gas plenum.

25. A radiant panel heater in accordance with claim 24 further comprising mixing means for mixing a first portion of an oxidant with a fuel, said mixing means having a mixed fuel/oxidant outlet in fluid communication with said combustion chamber.

26. A radiant panel heater in accordance with claim 24 further comprising a perforated plate disposed within said primary oxidant plenum substantially parallel to and spaced apart from said oxidant plenum wall and said exhaust gas plenum wall, said perforated plate forming a primary combustion oxidant outlet in fluid communication with said premixing means.

27. A radiant panel heater in accordance with claim 24, wherein said fluid communication between said primary oxidant plenum and said combustion chamber comprises a plurality of oxidant conduits extending between said primary oxidant plenum and said combustion chamber.

28. A radiant panel heater in accordance with claim 24, wherein said heat radiating wall comprises an inside surface of a heating chamber wall.

29. A radiant panel heater in accordance with claim 24, wherein at least one of said exhaust gas plenum wall, said combustion chamber wall and said heat radiating wall comprises at least one heat transfer enhancement.

30. A radiant panel heater in accordance with claim 29, wherein said at least one heat transfer enhancement comprises a plurality of dimples formed by at least one surface of at least one of said exhaust gas plenum wall, said combustion chamber wall and said heat radiating wall.

31. A radiant panel heater in accordance with claim 24, wherein an insulating layer is disposed on a combustion chamber facing surface of said back wall.

32. A radiant panel heater in accordance with claim 24, wherein said combustion chamber wall is conical, forming a conical shaped combustion chamber.

* * * * *